US012752983B2

(12) United States Patent
Darst et al.

(10) Patent No.: US 12,752,983 B2
(45) Date of Patent: Oct. 6, 2026

(54) CONTAINER WITH DISPENSER LID

(71) Applicant: Apothecary Products, LLC, Burnsville, MN (US)

(72) Inventors: Daniel Darst, Zimmerman, MN (US); Julia Olson Augdahl, Prior Lake, MN (US)

(73) Assignee: Apothecary Products, LLC, Burnsville, MN (US)

( * ) Notice: Subject to any disclaimer, the term of this patent is extended or adjusted under 35 U.S.C. 154(b) by 149 days.

(21) Appl. No.: 18/647,713

(22) Filed: Apr. 26, 2024

(65) Prior Publication Data

US 2025/0333216 A1 Oct. 30, 2025

(51) Int. Cl.

| | |
|---|---|
| ***B65D 47/26*** | (2006.01) |
| ***B65D 25/08*** | (2006.01) |
| ***B65D 47/12*** | (2006.01) |

(52) U.S. Cl.

CPC ..... *B65D 47/265* (2013.01); *B65D 25/08* (2013.01); *B65D 47/122* (2013.01)

(58) Field of Classification Search

CPC .... B65D 47/265; B65D 25/08; B65D 47/122; B65D 83/04; A61J 1/03

See application file for complete search history.

(56) References Cited

U.S. PATENT DOCUMENTS

| | | | | |
|---|---|---|---|---|
| 3,332,586 | A * | 7/1967 | Amburgey | B65D 47/286 222/561 |
| 4,288,006 | A | 9/1981 | Clover, Jr. | |
| D268,648 | S | 4/1983 | Stark | |
| 4,380,307 | A | 4/1983 | Stillinger | |
| 4,583,661 | A | 4/1986 | Clover, Jr. | |
| D292,889 | S | 11/1987 | Ostrowsky | |
| 4,925,067 | A * | 5/1990 | Zemlo | B65D 47/286 222/561 |
| 4,993,584 | A * | 2/1991 | Macario | A47G 19/32 220/523 |
| 5,135,139 | A * | 8/1992 | Krawagna | B65D 47/263 222/549 |
| D336,016 | S | 6/1993 | Reeves-Jackson | |
| 5,762,199 | A | 6/1998 | Aguilera | |
| 5,845,816 | A | 12/1998 | Krane | |
| D476,898 | S | 7/2003 | Schuller et al. | |
| D499,552 | S | 12/2004 | Nissanoff et al. | |
| D571,152 | S | 6/2008 | Tien | |
| D647,760 | S | 11/2011 | Pearson | |

(Continued)

FOREIGN PATENT DOCUMENTS

| | | |
|---|---|---|
| CN | 205441423 U | 8/2016 |
| EP | 911274 A1 | 4/1999 |

(Continued)

*Primary Examiner* — Vishal Pancholi

(74) *Attorney, Agent, or Firm* — Merchant & Gould P.C.

(57) ABSTRACT

A container can be used to store and dispense medication (e.g., vitamins, pills, tablets, etc.) or other discrete objects. The container has a body that holds objects in one or more separate chambers. A dispenser lid can be rotationally aligned to provide access to any of the chambers. A cover on the dispenser lid slides or otherwise moves to selectively open an access aperture defined by the dispenser lid. The cover may be releasably retained in the open and closed positions.

19 Claims, 15 Drawing Sheets

(56) References Cited

U.S. PATENT DOCUMENTS

| | | | | |
|---|---|---|---|---|
| 8,152,020 | B2 * | 4/2012 | Flowers | A61J 7/0409 221/7 |
| D696,940 | S | 1/2014 | Hale et al. | |
| 8,701,941 | B2 * | 4/2014 | Fuller | B65D 83/06 222/148 |
| D717,115 | S | 11/2014 | Lane et al. | |
| D722,476 | S | 2/2015 | Kilduff et al. | |
| D808,218 | S | 1/2018 | Seiders et al. | |
| 10,065,774 | B1 * | 9/2018 | Daniels, Jr. | B65D 51/242 |
| 10,232,992 | B2 | 3/2019 | Seiders et al. | |
| 10,836,547 | B2 | 11/2020 | Chapman et al. | |
| 10,869,578 | B2 | 12/2020 | Fang et al. | |
| 11,089,892 | B2 | 8/2021 | Manochio | |
| D951,095 | S | 5/2022 | Hagger et al. | |
| 11,492,191 | B2 | 11/2022 | Klein | |
| D973,494 | S | 12/2022 | Levinson | |
| D975,505 | S | 1/2023 | Pentelovitch et al. | |
| D980,075 | S | 3/2023 | Yamamoto et al. | |
| 11,877,985 | B2 * | 1/2024 | White | A61J 1/2093 |
| 2003/0234195 | A1 | 12/2003 | Earl et al. | |
| 2015/0158632 | A1 | 6/2015 | Wilhelm et al. | |
| 2016/0368663 | A1 | 12/2016 | Hizon | |
| 2017/0190496 | A1 | 7/2017 | Yang et al. | |
| 2017/0231867 | A1 | 8/2017 | Maston et al. | |
| 2019/0315518 | A1 | 10/2019 | Lyden | |
| 2021/0300661 | A1 | 9/2021 | Chen | |

FOREIGN PATENT DOCUMENTS

| | | | |
|---|---|---|---|
| KR | 1020020065110 | A | 8/2002 |
| KR | 200391434 | Y1 | 8/2005 |

* cited by examiner

CONTAINER WITH DISPENSER LID

BACKGROUND

For persons who need to take medicine (e.g., pills, vitamins, etc.) regularly, the need for a container that can be easily carried is important. A pill container that is easy to use, has sufficient capacity for the person's needs, and which can be conveniently carried by the user increases the likelihood that the user will take the correct medication at the correct time. In addition, in many instances, such persons need to manage multiple types of medication. It is desirable to provide storage containers which allow for management of daily pill regimen.

When traveling with pill containers, the jostling of luggage can sometimes cause pill containers to come open and spill the contents within the luggage. This is undesirable and inconvenient. Thus, lockable pill containers can be useful in a setting in which it is desired to prevent the containers from inadvertently opening.

It is desirable for the contents of the container to be secure, but easily accessible. For example, it is desirable that pill containers should not present a difficulty for people with limited dexterity or painful joints.

SUMMARY

In accordance with aspects of the disclosure, one or more objects can be dispensed from a container. The container includes a body configured to hold the objects and a lid configured to enable dispensing of the objects. The container also may include a cap that encloses or seals the lid. In certain examples, the cap includes a handle.

In accordance with some aspects, the lid includes a retainer that is rotationally fixed to the container body and a dispenser that rotates relative to the retainer. The dispenser defines an access aperture that provides access to the interior of the container body. In certain implementations, rotating the dispenser aligns the access aperture with a specific chamber within the container.

In certain implementations, the retainer mounts to the container body and the dispenser mounts to the retainer.

In certain implementations, the retainer mounts to an interior of the container body and the cap mounts to an exterior of the container body.

In certain implementations, the dispenser carries a cover that selectively blocks the access aperture. In certain examples, the cover can be retained in a closed position blocking the access aperture. In certain examples, the cover can be retained in the open position providing access to the access aperture. In certain examples, the cover slides between the open and closed positions.

In accordance with other aspects, a process of dispensing an object from a container includes: sliding an aperture cover of a lid of the container to an open position to reveal an access aperture; and rotating a portion of the lid to align the access aperture with a chamber within the body of the container. In certain examples, the process also includes automatically retaining the aperture cover in the open position. In certain examples, the process includes removing a cap from a body of the container to provide access to the lid of the container.

In accordance with other aspects, a process of assembling a container includes: inserting a divider into an interior of a body of the container, the body having an open top, the divider separating the interior into a plurality of chambers; and assembling a lid including mounting a dispenser to a retainer so that the dispenser is rotationally moveable relative to the retainer and is axially stationary relative to the retainer, the dispenser defining an access aperture. In certain implementations, the process includes mounting the lid to the body by snap-fitting the retainer of the lid to an interior surface of the body, the retainer defining a plurality of apertures. In certain implementations, the process includes securing the retainer in a rotationally fixed position relative to the body wherein each aperture of the retainer aligns with one of the chambers.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
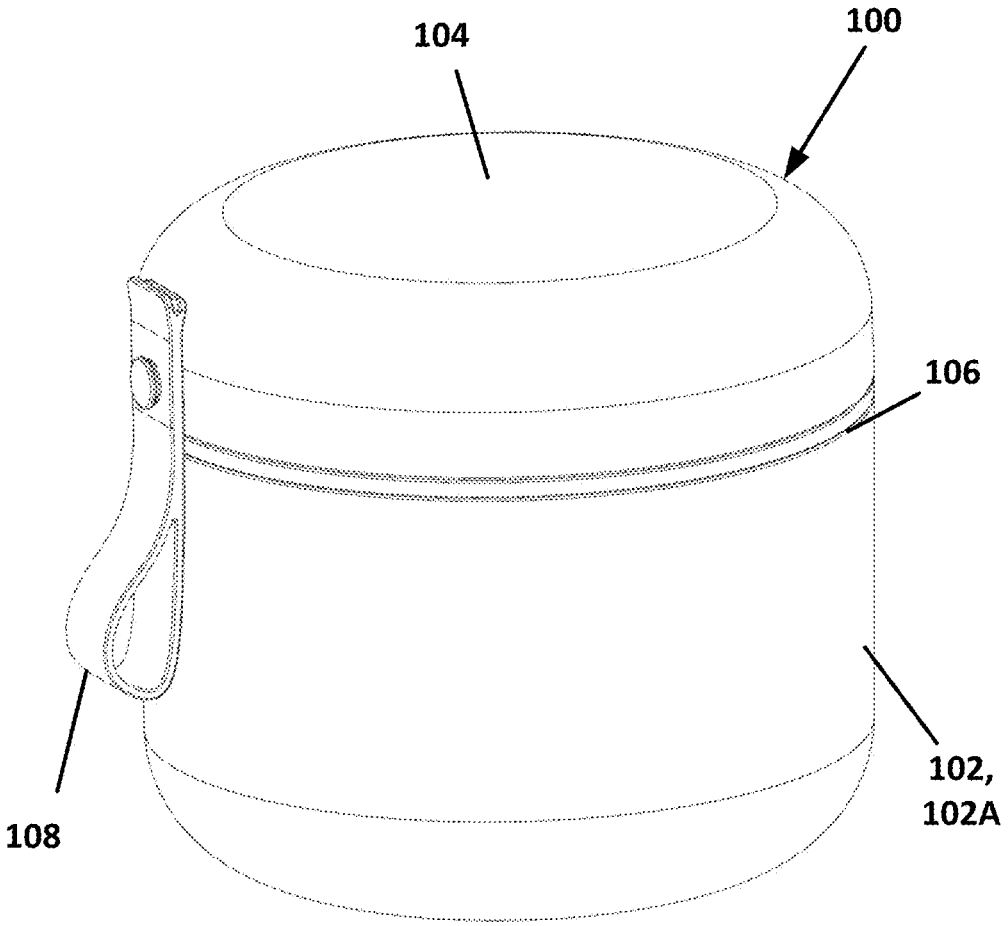
FIG. 1 is a perspective view of an example container configured in accordance with the principles of the present disclosure.
Figure 2:
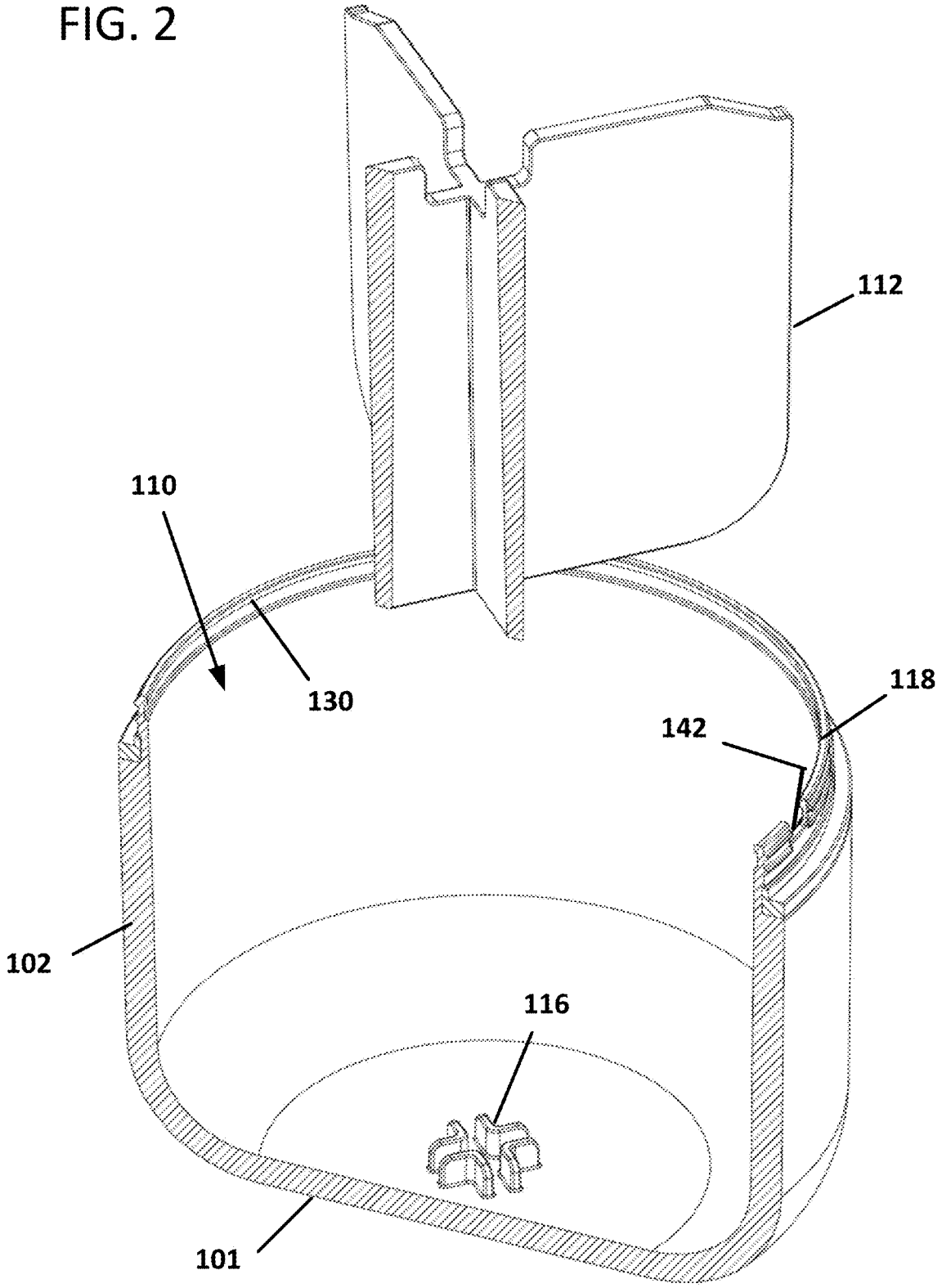
FIG. 2 shows an example divider insert exploded outwardly from an interior of the container of FIG. 1.

Reference will now be made in detail to exemplary aspects of the present disclosure that are illustrated in the accompanying drawings. Wherever possible, the same reference numbers will be used throughout the drawings to refer to the same or like parts.

The present disclosure is directed to a container 100 for storing discrete objects (e.g., pills, tablets, vitamins, etc.). The container 100 includes a body 102 defining an interior 110 (FIG. 3) in which the discrete objects may be disposed. The body 102 has a height H extending from a closed end 101 to an open end 103. The body 102 also has a cross-dimension C (e.g., a diameter in the case of a round body) that is transverse to the height H. In certain implementations, the interior 110 extends along at least a majority of the height H of the body 102. In certain implementations, the interior 110 extends along at least a majority of the cross-dimension D of the body 102.

Figure 9:
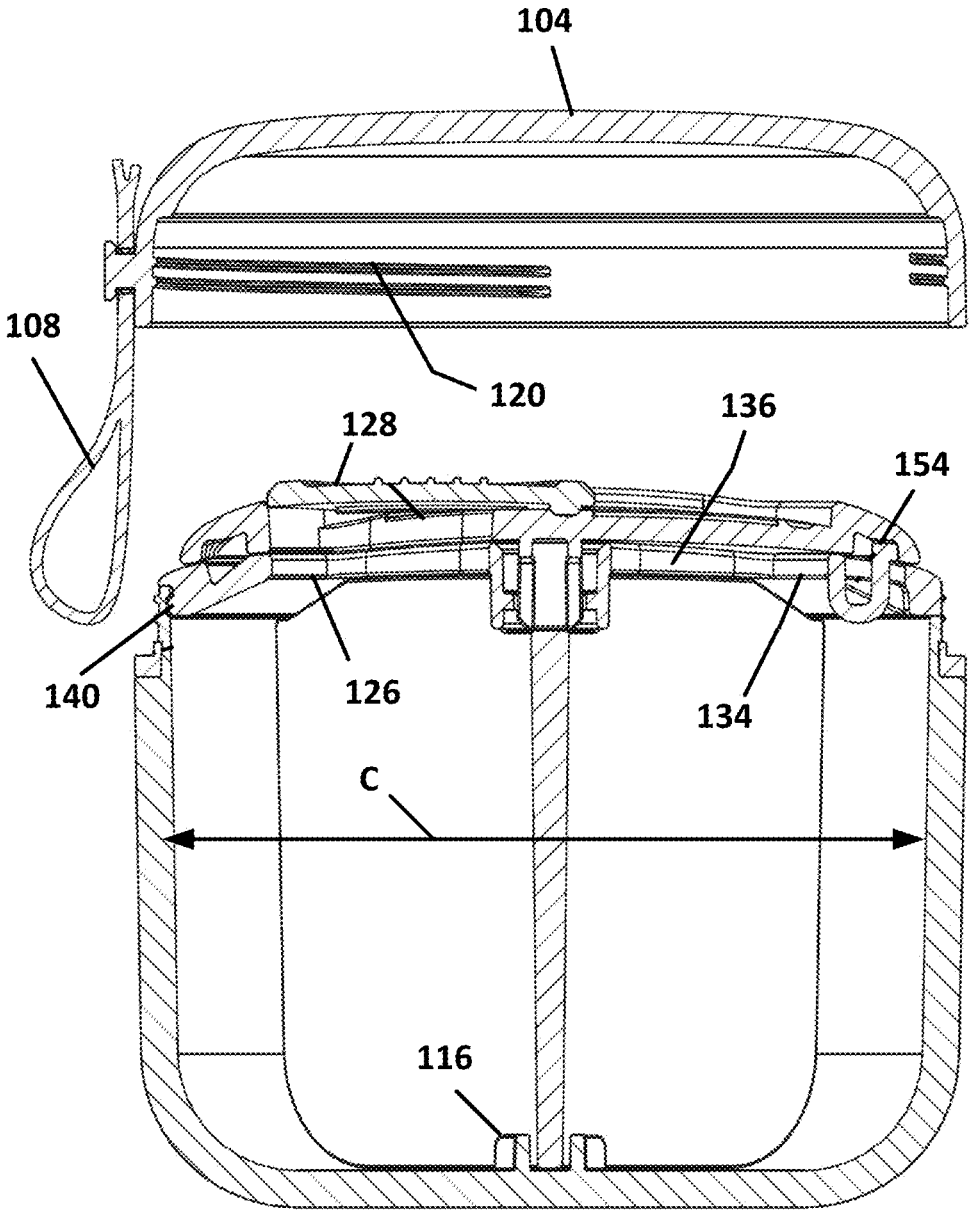
FIG. 9 is a cross-sectional view of the container body, lid, and cap of FIG. 3 taken along the line 9-9 of FIG. 16.

The container 100 also has a cap 104 that mounts to the body 102 (e.g., see FIG. 1). In certain implementations, the cap 104 attaches to the body 102 with a twist-to-lock mechanism. For example, the cap 104 may be threaded to the body 102. In the example shown, the container body 102 includes external threads 118 and the cap 104 includes internal threads 120 (e.g., see FIG. 9).

In certain implementations, the cap 104 seals to the body 102. For example, the body 102 and/or the cap 104 may carry a gasket 106 (e.g., rubber, foam, plastic, etc.) that seals the container interior 110 when the cap 104 is mounted to the body 102. In some implementations, the cap 104 carries the gasket 106. In other implementations, the gasket 106 is formed on the body 102 at the open end 103. In certain examples, the gasket 106 forms a waterproof seal between the cap 104 and the container body 102 to seal the interior 110 of the container 100.

In certain implementations, the cap 104 includes a handle 108 that extends outwardly from the cap 104 to facilitate conveyance, manipulation, or storage of the container 100. In certain examples, the handle 108 is removably attached to the cap 104. In certain examples, the handle 108 forms a loop. In certain examples, the handle 108 is formed of a common material with the gasket 106. In certain examples, the handle 108 is color-coded to the gasket 106.

In some implementations, the container body 102 and/or the cap 104 are formed of an opaque material. In other implementations, however, the container body 102 may be formed of a transparent material, thereby enabling viewing of the contents of the container 100 even while the cap 104 is mounted to the body 102. In certain implementations, the cap 104 may be formed of a transparent material to allow viewing of the contents of the container 100.

In certain implementations, a divider 112 is configured to be inserted into the container body 102 to separate the interior 110 into two or more chambers 114. In the example shown, the divider 112 separates the interior 110 into four chambers 114*a*-114*d*. Other configurations are possible. In some examples, the chambers 114*a*-114*d* are evenly sized and distributed. In other examples, the chambers 114 can have different sizes and/or shapes. In certain implementations, the container body 102 includes a mounting arrangement 116 configured to receive the divider 112. In certain examples, the mounting arrangement 116 maintains the divider 112 in a rotationally fixed position relative to the container body 102. Accordingly, the chambers 114 remain rotationally stationary relative to the container body 102.

In accordance with certain aspects of the disclosure, a lid 122 is mounted to the container body 102 at the open end 103. In certain implementations, the lid 122 is disposed between the container body 102 and the cap 104. In certain implementations, the lid 122 is mounted to the container body 102 independently of the cap 104. In certain examples, the cap 104 mounts to an exterior feature (e.g., external threads 118) of the container body 102 and the lid 122 mounts to an interior feature of the container body 102. For example, the container body 102 may define an inner groove 130 configured to receive a portion of the lid 122.

The lid 122 defines an access aperture 126 (e.g., see FIG. 4) that provides access to the interior 110 of the container body 102. The lid 122 includes a cover 128 that selectively blocks the access aperture 126. For example, the cover 128 can be moved between a closed position extending over the access aperture 126 (e.g., see FIG. 3) and an open position spaced from the access aperture 126 (e.g., see FIG. 4). In certain examples, the cover 128 is configured to slide between the open and closed positions. In certain implementations, the cover 128 can be releasably retained in the closed position as will be discussed in more detail herein. In certain implementations, the cover 128 can be releasably retained in the open position as will be discussed in more detail herein.

In certain implementations, at least a portion of the lid 122 is rotatable relative to the container body 102 to align the access aperture 126 with a selected one of the interior chambers 114. Accordingly, different types of objects (e.g., different types of vitamins, pills, tablets, etc.) can be stored in each chamber 114. By aligning the access aperture 126 with a specific chamber 114*a*-114*d*, the user can select which type of object to dispense from the container 100. In certain implementations, the lid 122 includes grip enhancement features that assist the user in rotating the access aperture 126 relative to the body 102. In certain examples, the grip enhancement features include one or more notches or detents 132 spaced about an outer periphery of the lid 122. Other configurations are possible (e.g., protruding tabs, textured surface(s), etc.).

Figure 5:
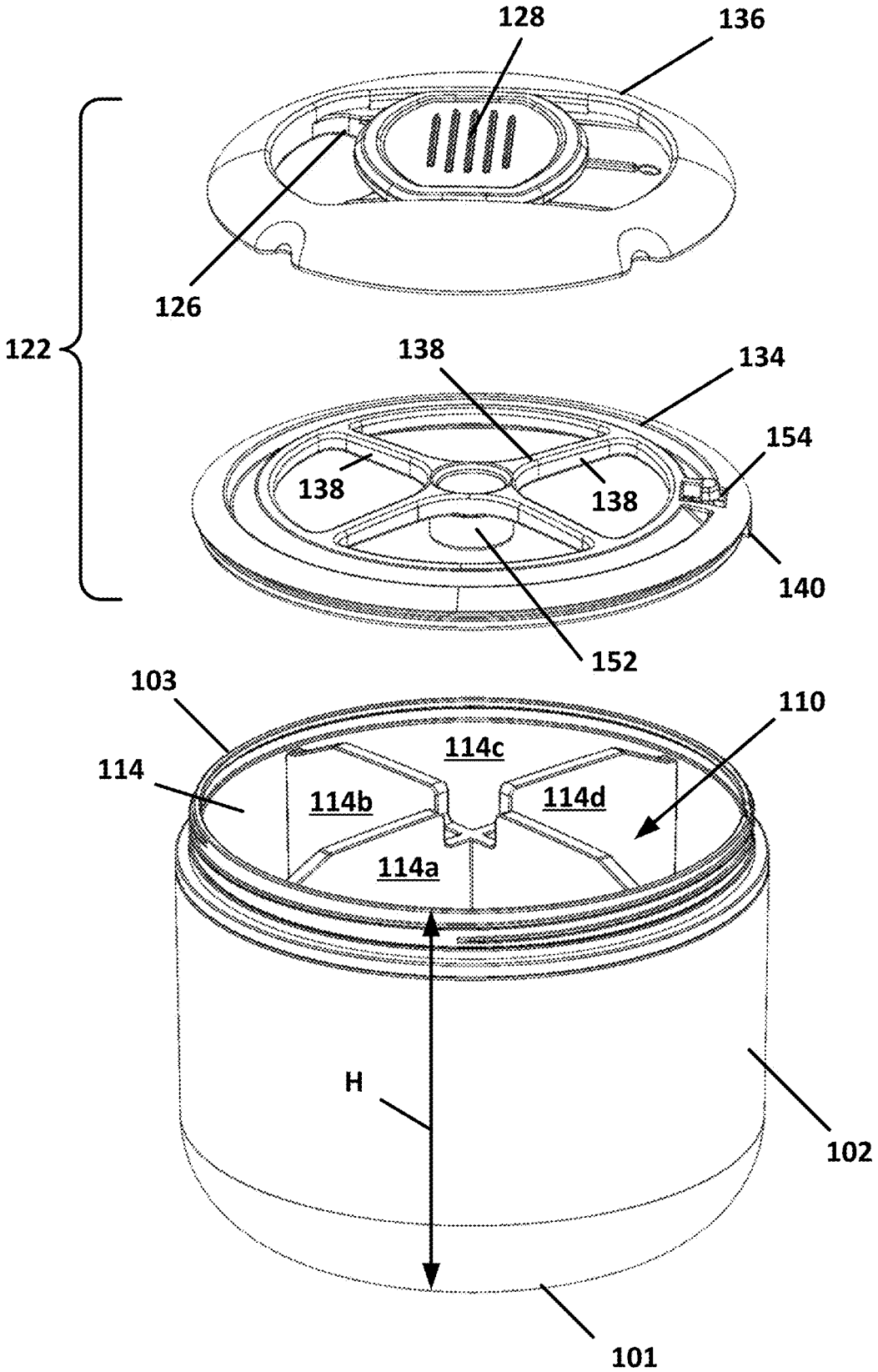
FIG. 5 is an exploded view of the container body and lid of FIG. 3, the lid being separated into a retainer and a dispenser.

In certain implementations, the lid 122 includes a retainer 134 and a dispenser 136. The dispenser 136 defines the access aperture 126. The cover 128 is mounted (e.g., slidably mounted) to the dispenser 136. The retainer 134 mounts to the container body 102. In certain implementations, the retainer 134 defines one or more apertures 138. The dispenser 136 mounts to the retainer 134. In certain examples, the dispenser 136 may be latched, snap-fit, press-fit, or otherwise secured to the retainer 134. In the example shown, the dispenser 136 includes a post 146 having teeth, fingers, or other protrusions 148 that snap-fit to an inner ledge 150 of the retainer 134 (e.g., see FIG. 9). In certain examples, the inner ledge 150 is defined by a post 152 of the retainer 134 that extends into the container body 102. In certain examples, the divider 112 defines a slot to receive the post 152 (e.g., see FIG. 5).

Figure 6:
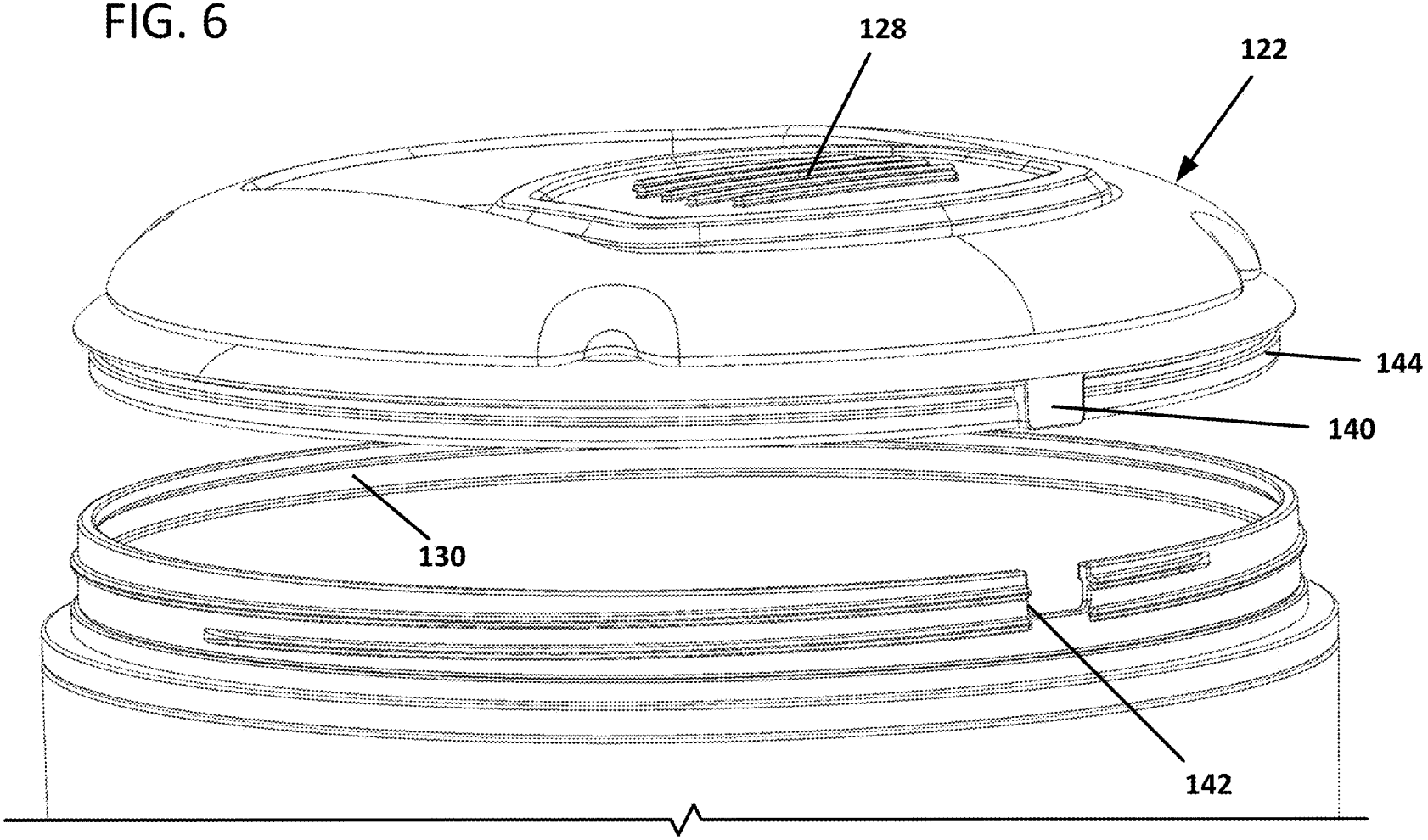
FIG. 6 shows the lid of FIG. 3 exploded away from the body so that a rotational engagement arrangement between the lid and the body is visible.

In certain implementations, the retainer 134 includes a band 144 configured to snap-fit or otherwise engage the inner groove 130 of the container body 102 to hold the lid 122 to the container body 102. In certain implementations, the retainer 134 mounts to the container body 102 in a rotationally fixed position. For example, the retainer 134 may include a tab 140 or other protrusion that fits into a notch 142 defined in the container housing 102 (e.g., see FIG. 6). In certain examples, the retainer 134 is configured to mount to the container body 102 in a rotationally fixed position in which each aperture 138 of the retainer 134 aligns with a corresponding one of the chambers 114.

The dispenser 136 is configured to rotate relative to the retainer 134 and, hence, relative to the container body 102. Rotating the dispenser 136 relative to the retainer 134 enables the user to align the access aperture 126 with the selected chamber 114*a*-114*d*. In certain implementations, the dispenser 136 and retainer 134 are configured to releasably retain the dispenser 136 to the retainer 134 in one of a plurality of predetermined rotational positions. For example, each rotational position may correspond with the access aperture 126 of the dispenser 136 aligning with one of the apertures 138 of the retainer 134.

Figure 7:
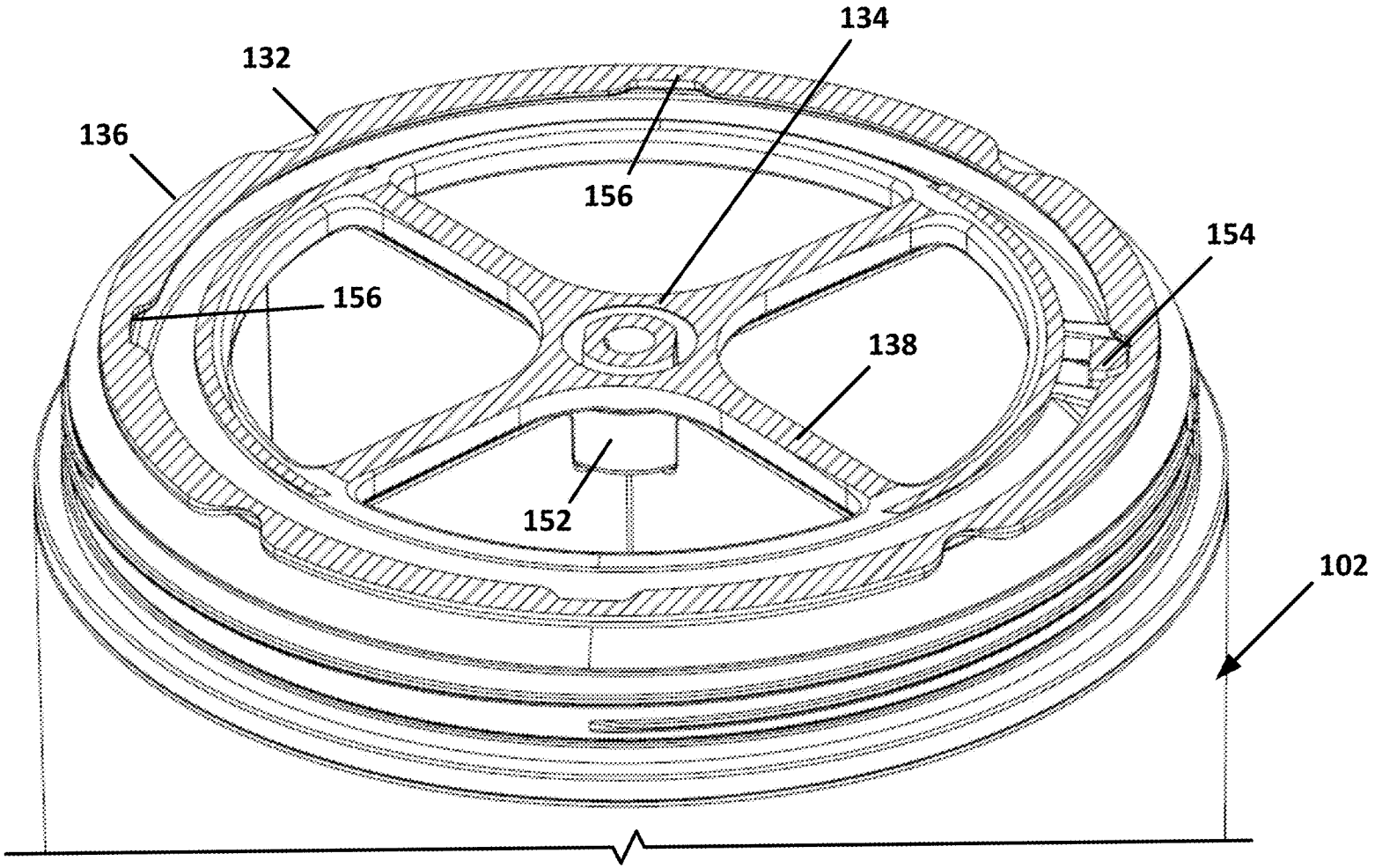
FIG. 7 is a cross-sectional view of the lid showing a latch finger of the retainer engaged in a notch of the dispenser.

In certain implementations, the retainer 134 includes a latch finger 154 that is configured to flex radially along the cross-dimension C of the container body 102 (e.g., see FIG. 7). In certain implementations, the dispenser 136 defines a plurality of inwardly-facing notches 156 (e.g., see FIGS. 7 and 8). For example, the dispenser 136 may have an annular sidewall along which the inwardly-facing notches 156 are spaced. The latch finger 154 snaps into each notch 156 when aligned therewith, thereby rotationally retaining the dispenser 136 relative to the retainer 134 and container body 102. Other configurations are possible (e.g., the dispenser 136 having a latch finger and the retainer 134 defining the notches). Accordingly, the lid 122 indicates to a user when the dispenser 122 is aligned with one of the chambers 114, thereby mitigating alignment of the access aperture 126 with more than one chamber 114 at once.

Figure 8:
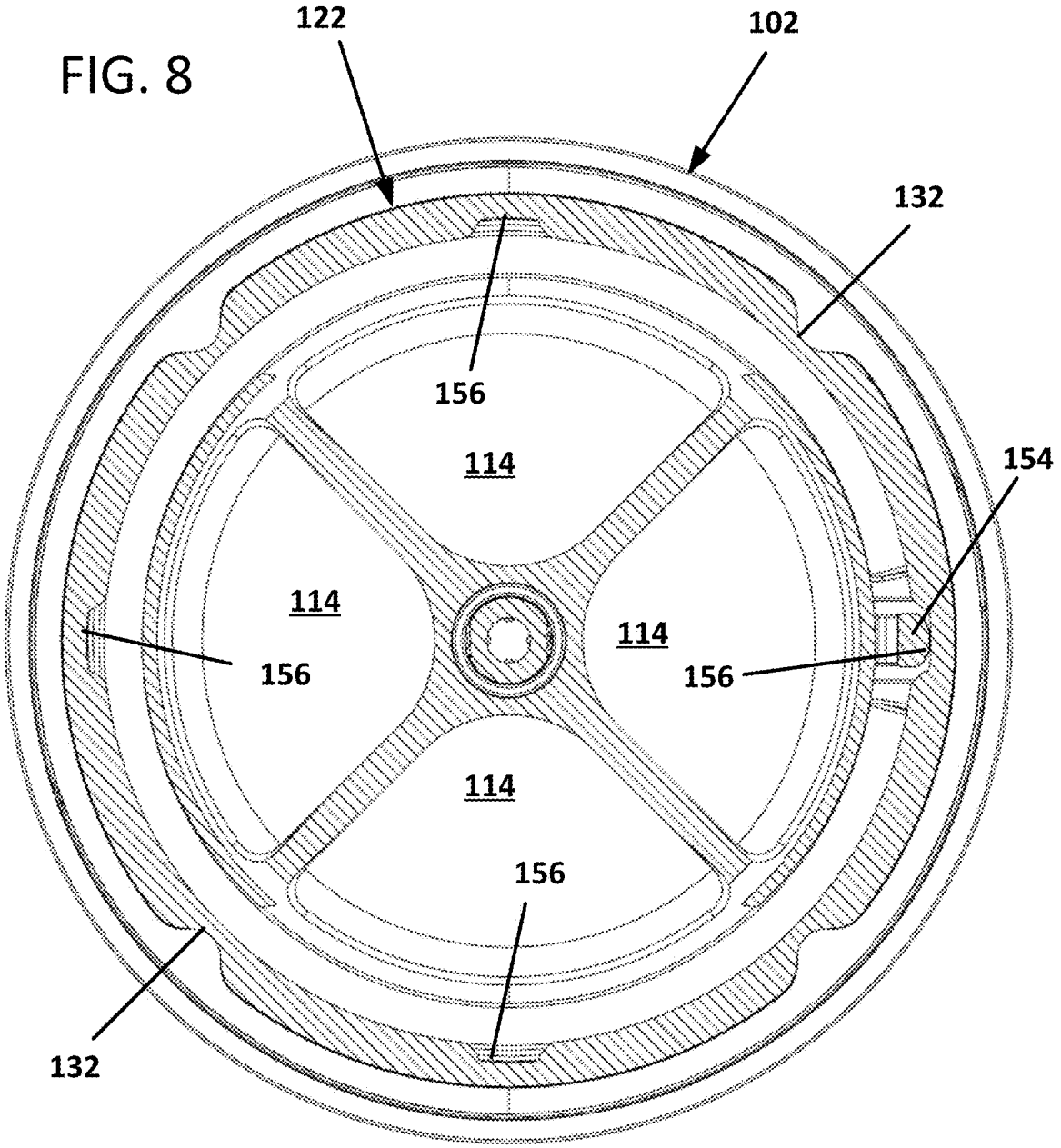
FIG. 8 is a top plan view of the lid of FIG. 7.

In certain implementations, the notches 156 having ramped or contoured edges that enable the latch finger 154 to cam out of each notch 156 upon the application of a predetermined rotational force to the dispenser 136 (e.g., see FIG. 8). The predetermined rotational force is sufficient to flex the latch finger 154 and allow the camming. Accordingly, the dispenser 136 is not free-wheeling relative to the retainer 134, but a user need not remember to specifically release the dispenser 136 to move the dispenser 136 relative to the retainer 134.

Figure 10:
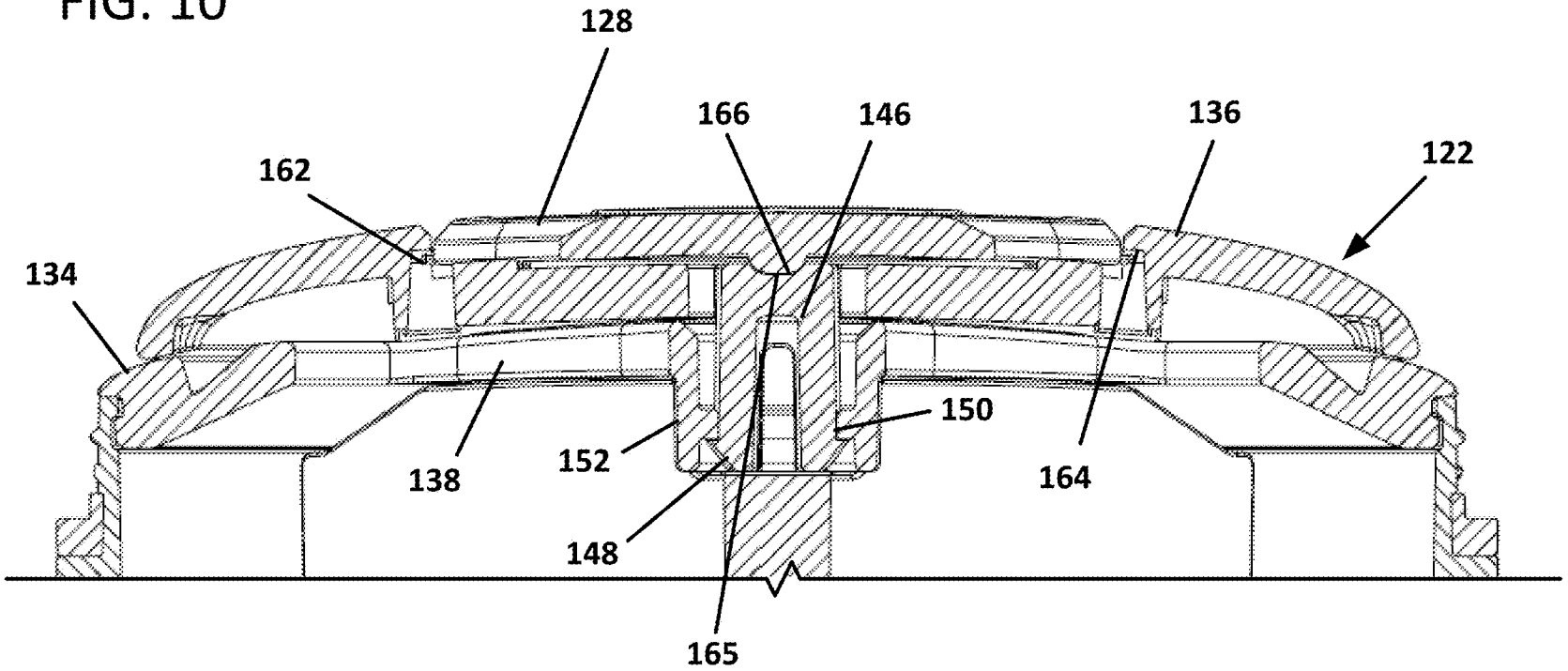
FIG. 10 is a cross-sectional view of the lid taken along the line 10-10 of FIG. 16.
Figure 11:
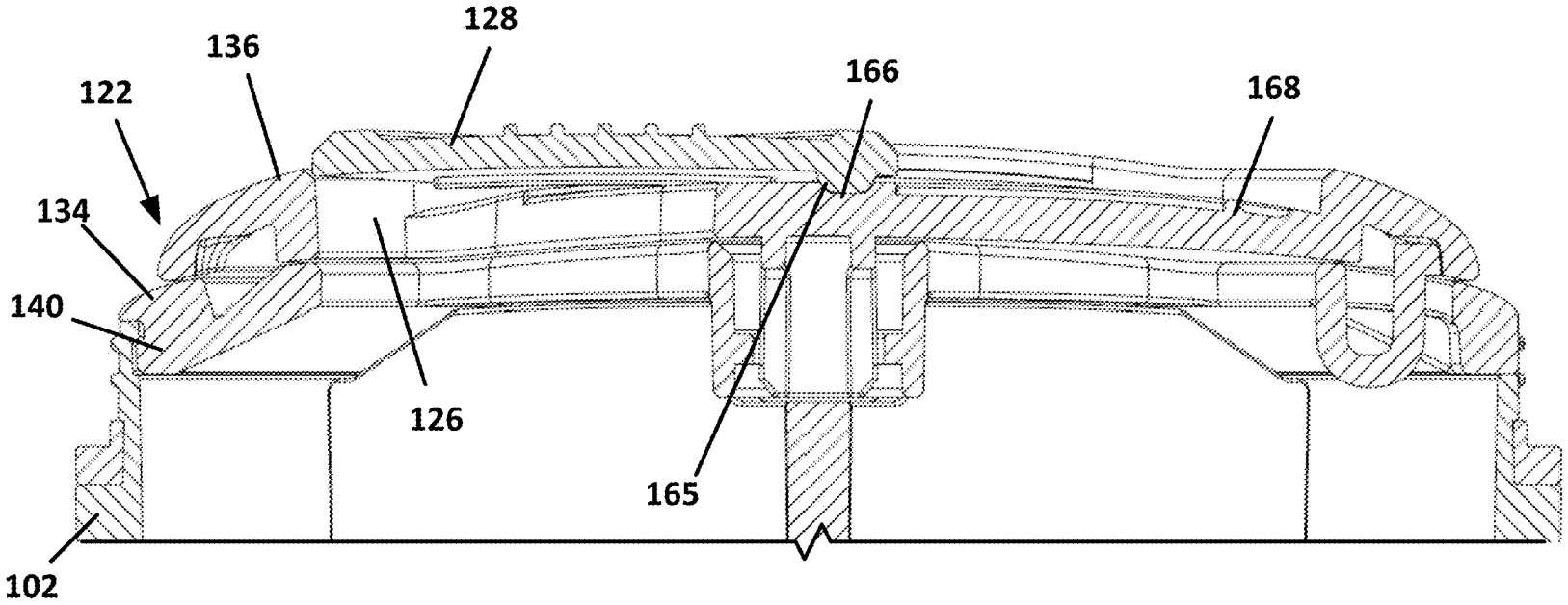
FIG. 11 is an enlarged view of a portion of FIG. 9.
Figure 12:
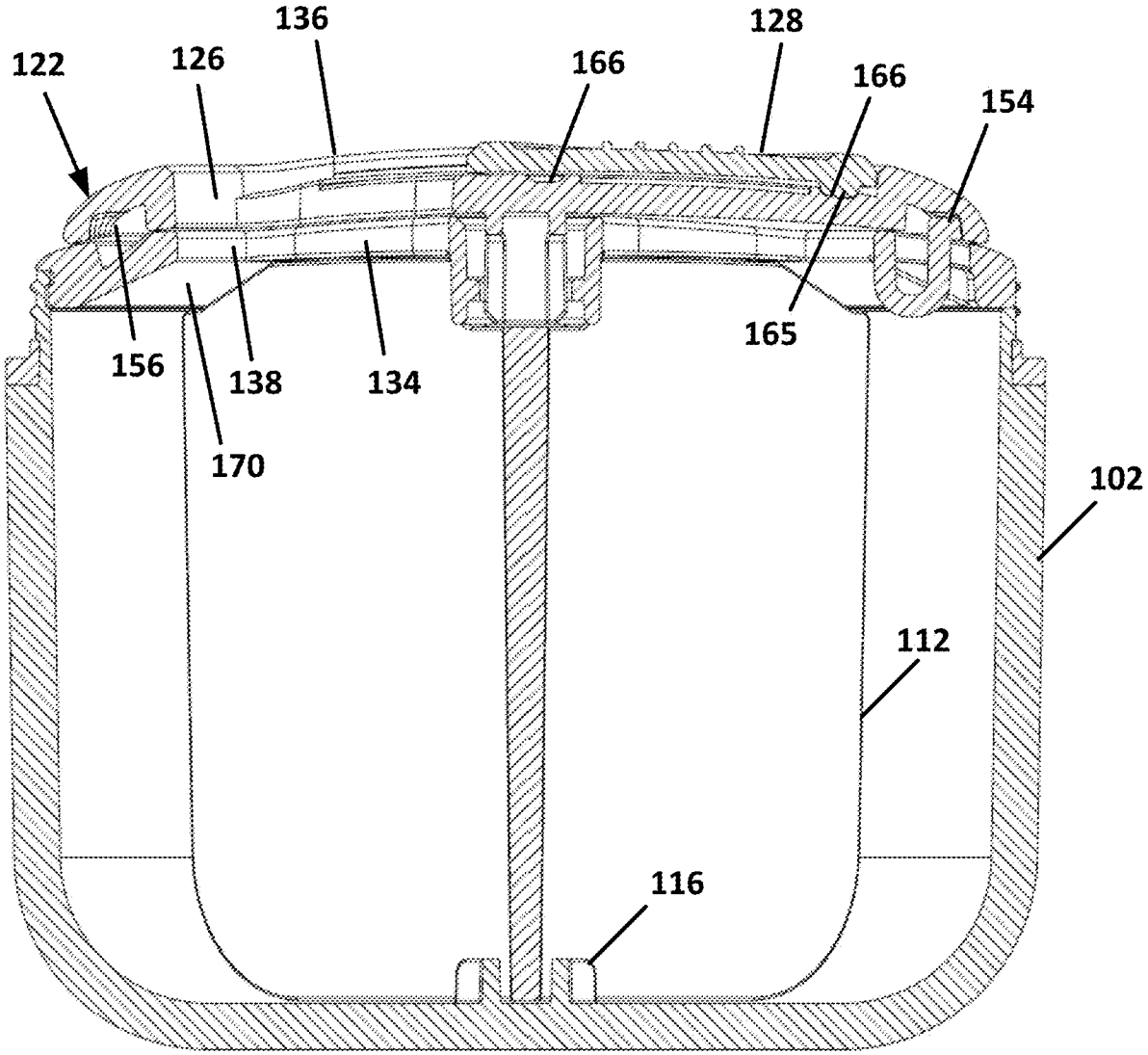
FIG. 12 is a cross-sectional view taken along the 9-9 line of FIG. 16 and showing the cover moved to the open position.

Referring now to FIGS. 10-12, the cover 128 is movably mounted to the dispenser 136. In certain implementations, the cover 128 is configured to slide relative to the dispenser 136. Other configurations are possible. In certain implementations, the dispenser 136 defines a channel 160 in which the cover 128 is disposed. In certain examples, the access aperture 126 is defined through the channel 160. In the example shown, the access aperture 126 is defined at an one end of the channel 160. The cover 128 slides along the channel 160 between the open and closed positions. In certain implementations, the cover 128 includes wings or tabs 162 that glide beneath overhangs 164 defined by the dispenser 136 to retain the cover 128 at the dispenser 136 (e.g., see FIG. 10).

In certain implementations, the cover 128 is configured to be releasably retained in the closed position. In certain examples, the cover 128 includes a bump 165 or other protrusion that extends away from the cover 128 and towards the dispenser 136. The dispenser 136 defines a detent 166 sized and shaped to receive the bump 165. The detent 166 is positioned on the dispenser 136 so that the bump 165 snaps into the detent 166 when the cover 128 is disposed in the closed position. Upon the application of a predetermined amount of force by the user, the bump 165 can be moved out of the detent 166 to slide along the channel 160. In certain examples, the channel 160 defines a groove 170 along which the bump 165 slides.

In certain implementations, the cover 128 is configured to be releasably retained in the open position. In certain examples, the dispenser 136 defines a second detent 168 within the channel 160. In certain examples, the second detent 168 is adjacent the groove 170 so that, when the cover 128 reaches the open position, the bump 165 snaps from the groove 170 into the second detent 168. Engagement between the bump 165 and the second detent 168 maintain the cover 128 in the open position until the application of a predetermined amount of force by the user to the cover 128. In certain implementations, the cover 128 includes a grip enhancement feature 172 (e.g., a textured surface) to assist the user in applying a sliding force to the cover 128.

In use, a user desiring to access an object within the container 100 will remove the cap 104 (e.g., unthread the cap 104) to access the lid 122. The user will rotate the dispenser 136 relative to the retainer 134 until the access aperture 128 aligns with a desired one of the chambers 114. In certain examples, the container body 102 is transparent to assist the user in selecting the desired chamber 114. The latch finger 154 will travel between notches 156 as the user rotates the dispenser 136. The latch finger 154 also assist in holding the dispenser 136 at the selected rotational position through engagement with the notch 156.

The user uncovers the access aperture 126 of the dispenser 136 to provide access to the selected chamber 114. For example, the user may slide the cover 128 of the dispenser 136 along a channel 160 from the closed position to the open position. In certain examples, the user applies a predetermined amount of force (e.g., a break-away force) to the cover 128 to move the cover away from the closed position. In certain examples, the cover 128 is automatically retained in the open position (e.g., through engagement of a bump and detent) upon reaching the open position. While the cover 128 is open, the user may tip the container 100 to pour one or more of the objects out of the selected chamber 114 through the access aperture 126. In certain implementations, the retainer 134 defines a ramp surface 170 that tapers radially inwardly as the ramp surface 170 extends from the container body 102 to the apertures 138. The ramp surface 170 assists the discrete objects in traveling from the selected chamber 114 to the access aperture 126 without becoming stuck under the lid 122 when the container 100 is tipped.

When finished, the user may again apply a break-away force to the cover 128 to move the cover 128 away from the open position. The cover 128 is slid along the channel 160 until the cover 128 extends over the access aperture 126. In certain examples, the cover 128 is automatically retained in the closed position (e.g., through engagement of a bump and detent) upon reaching the closed position. A user may seal the container interior by mounting (e.g., threading) a cap 104 onto the container body 102. The cap 104 encloses the lid 122.

Figure 3:
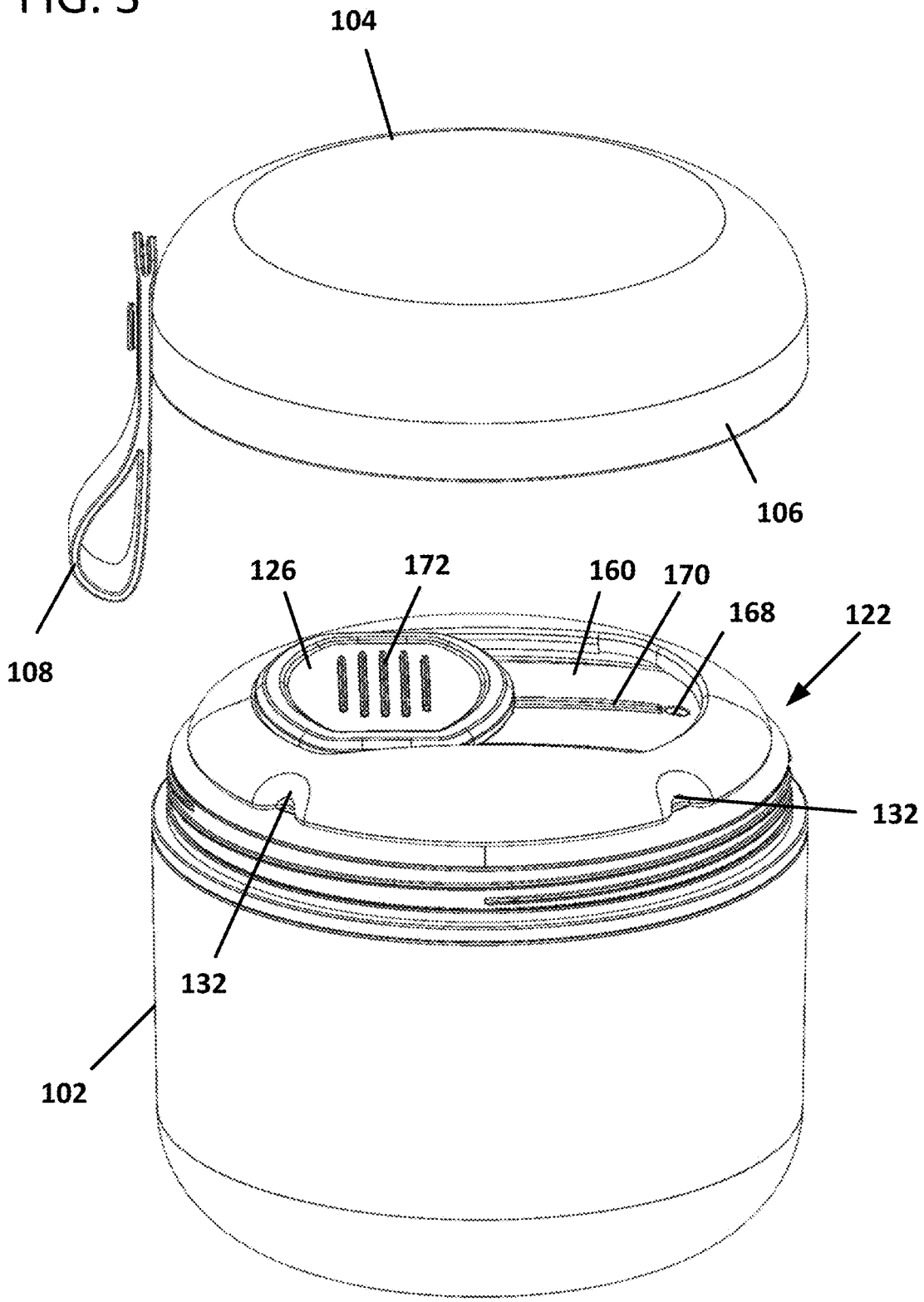
FIG. 3 shows the container of FIG. 1 with the cap exploded away from a body and lid of the container, the lid having a cover closing an access aperture.
Figure 4:
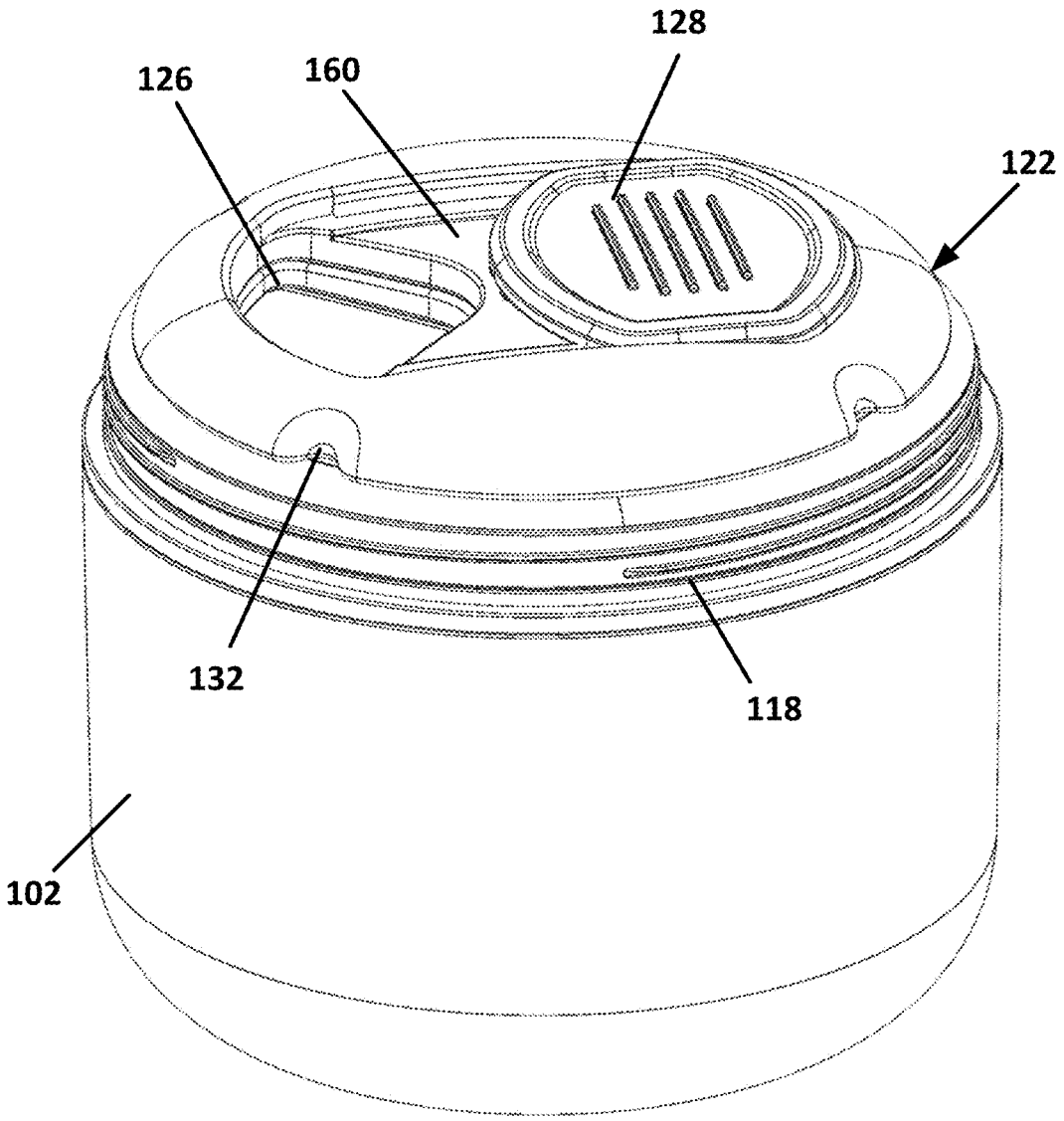
FIG. 4 is a perspective view of the body and lid of the container of FIG. 3, the cover being opened to expose the access aperture.
Figure 13:
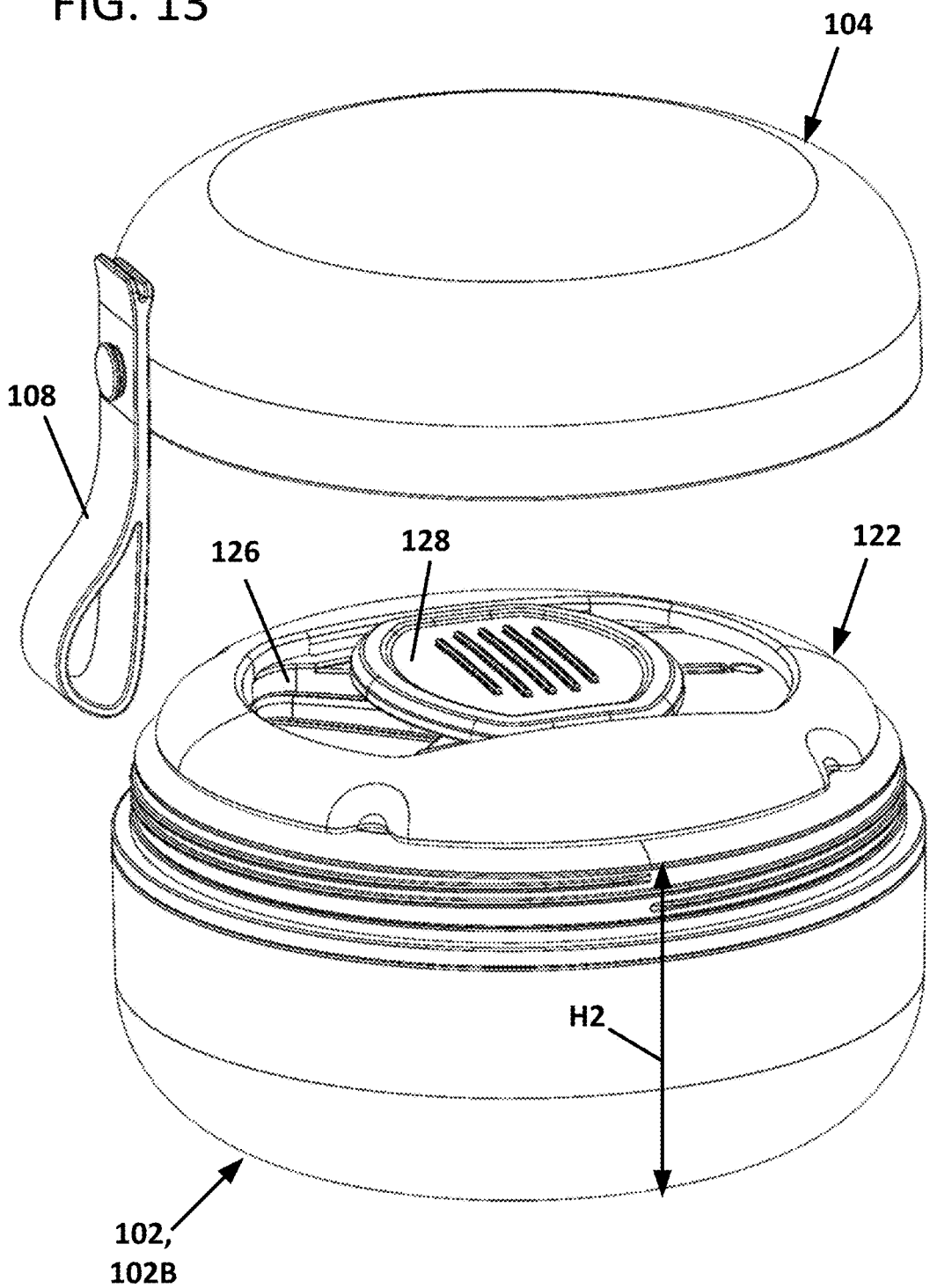
FIG. 13 shows the lid and cap of FIG. 3 mounted to a smaller container body.
Figure 14:
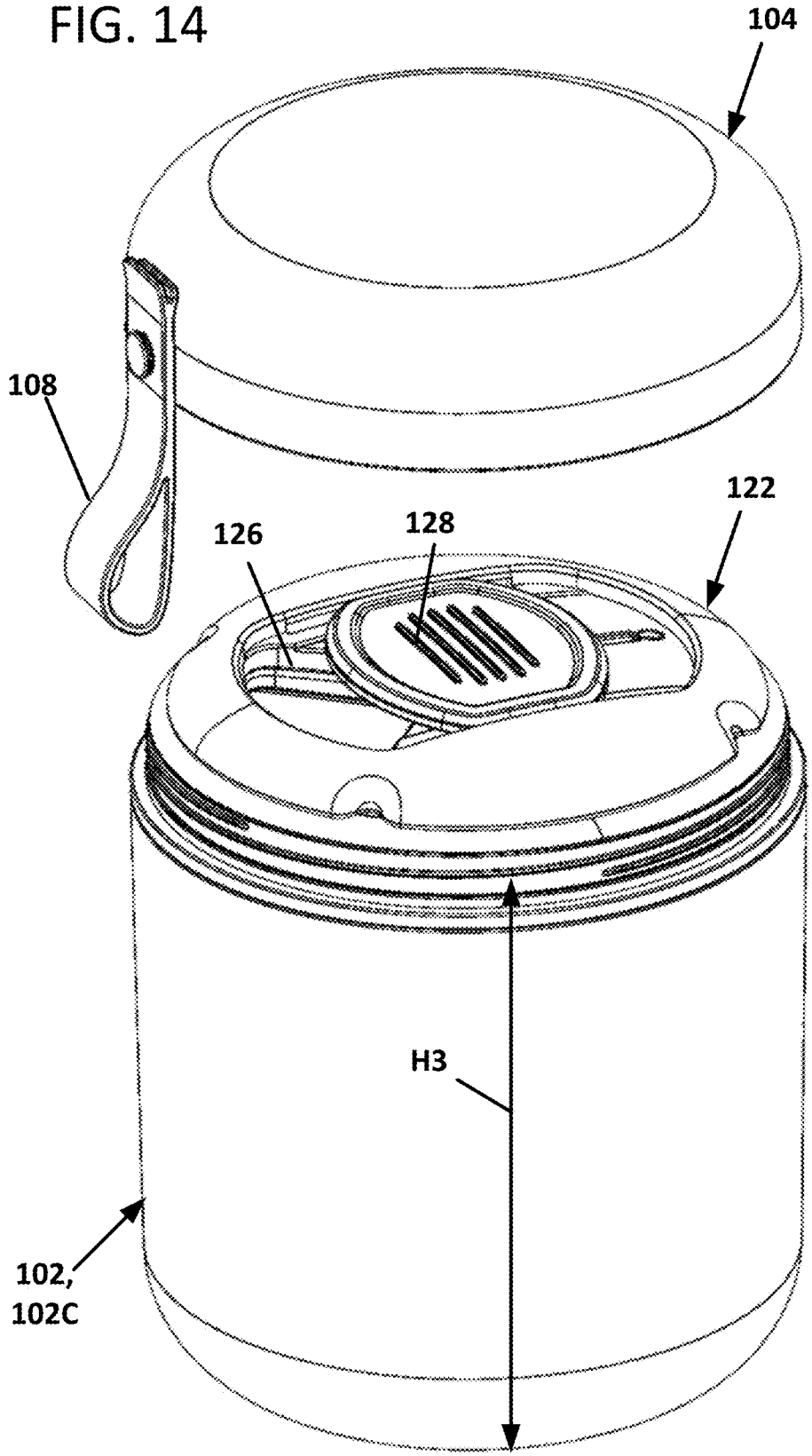
FIG. 14 shows the lid and cap of FIG. 3 mounted to a larger container body.
Figure 15:
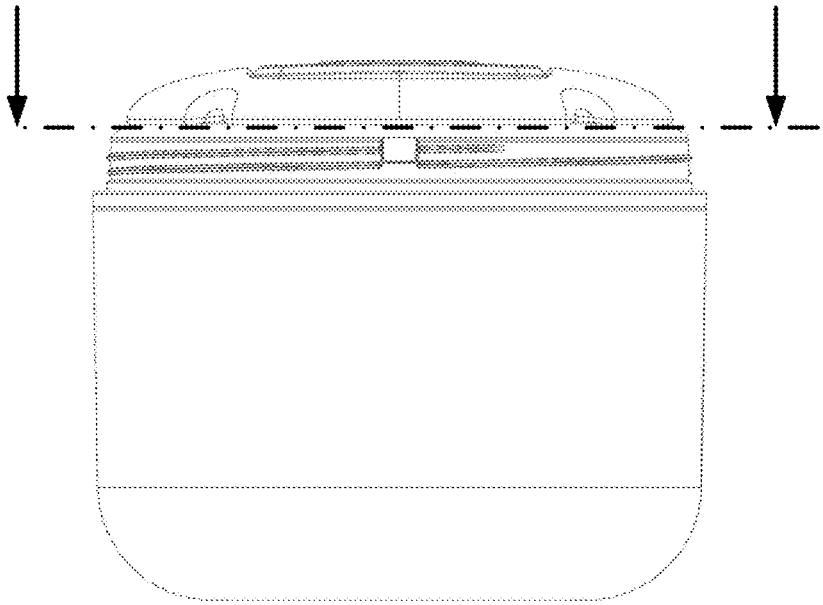
FIG. 15 is a side elevational view of the container body and lid of FIG. 3.
Figure 16:
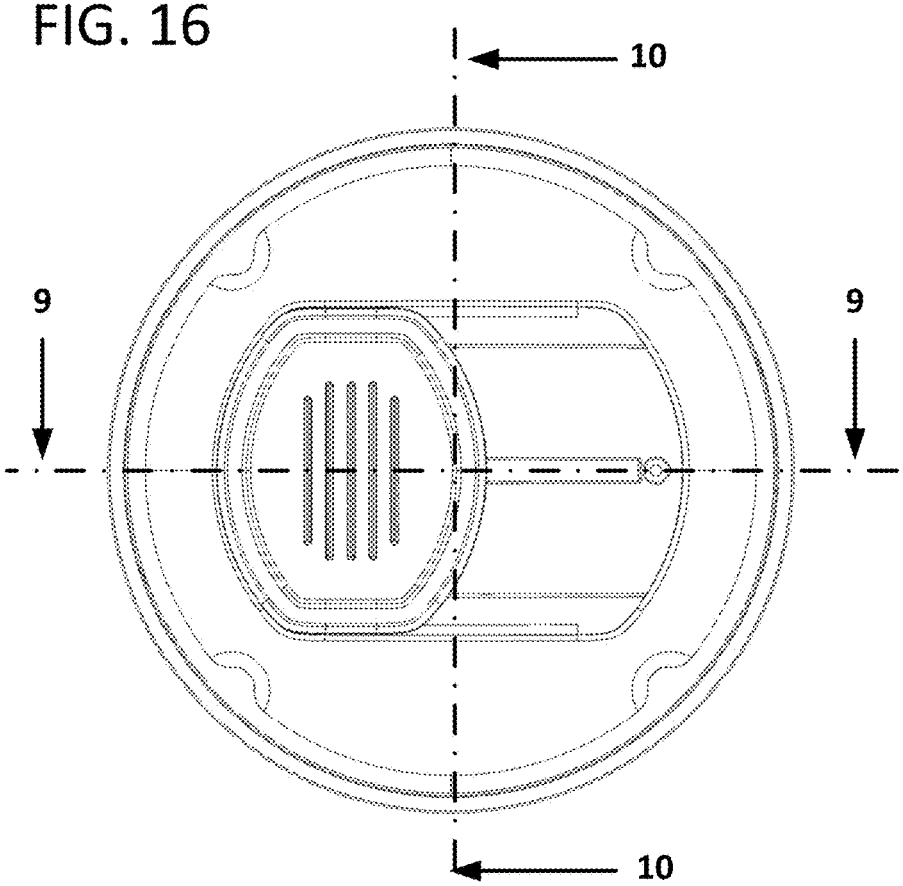
FIG. 16 is a top plan view of the container body and lid of FIG. 3.

Referring to FIGS. 3, 13, and 14, the lid 122 can be utilized with containers 100 of different size. For example, FIG. 3 shows the lid 122 mounted to a first container body 102A having a first height H. In FIG. 13, the lid 122 is mounted to a second container body 102B having a second height H that is smaller than the first height H. In FIG. 14, the lid 122 is mounted to a third container body 102C having a third height H that is larger than the first height H. In some implementations, the container bodies 102A, 102B, 102C may have a common cross-dimension C to enable the same lid 122 to mount to each. In other implementations, each container body size corresponds with a particular lid size. In certain examples, the gasket 106 and/or handle 108 of the containers 100 are color-coded based on the size of the container body 102. Other variations in the container 100 are possible. However, the particular containers 100 shown herein are preferred because they are eye-catching and attractive, in addition to being distinctive in appearance.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. A container comprising:

a body having an open top leading to an interior, the interior being divided into separate chambers; and a lid mounted at the open top of the body, the lid including:

a retainer configured to engage the body to secure the lid to the body, the retainer being rotationally fixed relative to the body, and the retainer including a latch finger; and a dispenser mounted to the retainer, the dispenser being rotatable relative to the retainer into one of a plurality of predetermined rotational positions, the dispenser defining an access aperture that aligns with a respective one of the chambers of the body in each predetermined rotational position, the dispenser carrying an aperture cover that selectively opens and closes the access aperture; the dispenser defining a plurality of detents disposed about an inner periphery of the dispenser;

wherein the latch finger snaps into each detent in turn as the dispenser is rotated relative to the retainer; and wherein the dispenser is held in each of the predetermined rotational positions through engagement between the latch finger and a respective one of the detents.

2. The container of claim 1, further comprising a cap that mounts to the body to enclose the lid and to seal the interior of the body.

3. The container of claim 2, wherein the cap includes:

a gasket that forms a seal between the cap and the body, and a handle attached to the cap.

4. The container of claim 2, wherein the cap engages an exterior threads of the body and the retainer engages an interior groove of the body.

5. The container of claim 1, wherein the aperture cover is configured to move between an open position in which the aperture cover is spaced from the access aperture and a closed position in which the aperture cover blocks the access aperture.

6. The container of claim 5, wherein the aperture cover slides between the open and closed positions.

7. The container of claim 5, wherein the access aperture is releasably retained in the open position automatically upon reaching the open position.

8. The container of claim 1, wherein each detent has ramped or contoured sides to enable camming of the latch finger out of the detent.

9. The container of claim 1, wherein an outer periphery of the dispenser includes grip enhancers.

10. The container of claim 9, wherein the grip enhancers include outwardly-facing detents spaced about an outer periphery of the dispenser.

11. The container of claim 1, wherein the dispenser is latched to the retainer.

12. The container of claim 1, further comprising an insert disposed within the interior of the body to define the chambers, the insert being held in a rotationally fixed position relative to the body.

13. The container of claim 1, wherein the retainer defines a plurality of apertures that each align with a respective one of the chambers, wherein the access aperture of the dispenser aligns with respective ones of the apertures of the retainer as the dispenser is rotated between the predetermined rotational positions.

14. A method of dispensing an object from a container, the method comprising:

removing a cap from a body of the container to provide access to a lid of the container;

sliding an aperture cover of the lid to an open position to reveal an access aperture and automatically retaining the aperture cover in the open position; and rotating a dispenser portion of the lid relative to a retainer portion of the lid to align the access aperture with a chamber within the body of the container, wherein the rotating causes a latch finger of the retainer portion to snap into detents disposed about an inner periphery of the dispenser portion in turn, thereby holding the dispenser portion in each of a plurality of predetermined rotational positions through engagement between the latch finger and a respective one of the detents.

15. The method of claim 14, wherein rotating the dispenser portion of the lid includes gripping outwardly-facing detents of the lid to rotate the dispenser portion.

16. The method of claim 14, further comprising sliding the aperture cover of the lid to a closed position to cover the access aperture and automatically retaining the aperture cover in the closed position.

17. The method of claim 14, further comprising sealing the container by mounting the cap back onto the body of the container.

18. A method of assembling a container, the method comprising:

inserting a divider into an interior of a body of the container, the body having an open top, the divider separating the interior into a plurality of chambers;

assembling a lid including mounting a dispenser to a retainer so that the dispenser is rotationally moveable relative to the retainer and is axially stationary relative to the retainer, the dispenser defining an access aperture, wherein the mounting includes positioning a latch finger of the retainer to engage with a plurality of detents disposed about an inner periphery of the dispenser such that the latch finger snaps into each detent in turn as the dispenser is rotated relative to the retainer, thereby holding the dispenser in each of a plurality of predetermined rotational positions;

mounting the lid to the body by snap-fitting the retainer of the lid to an interior surface of the body, the retainer defining a plurality of apertures;

securing the retainer in a rotationally fixed position relative to the body wherein each aperture of the retainer aligns with one of the chambers.

19. The method of claim 18, further comprising mounting a cap to the body to enclose the lid.

* * * * *